United States Patent [19]

Ghaderi et al.

[11] Patent Number: 4,668,864

[45] Date of Patent: May 26, 1987

[54] MASS SPECTROMETER

[75] Inventors: Sahba Ghaderi; Duane P. Littlejohn, both of Madison, Wis.

[73] Assignee: Nicolet Instrument Corporation, Madison, Wis.

[21] Appl. No.: 643,280

[22] Filed: Aug. 22, 1984

[51] Int. Cl.[4] ..... H01J 49/14

[52] U.S. Cl. ..... 250/291; 250/290; 250/281; 250/285; 250/427

[58] Field of Search ..... 250/291, 290, 281, 285, 250/427

[56] References Cited

U.S. PATENT DOCUMENTS 4,458,148 7/1984 Hirshfield et al. ..... 250/281

*Primary Examiner*—Bruce C. Anderson
*Assistant Examiner*—Jack I. Berman
*Attorney, Agent, or Firm*—Kinney & Lange

[57] ABSTRACT

A mass spectrometer of the type wherein a solenoidal magnet produces a magnetic field that includes a region along its geometric central axis. That region is a region of high field intensity and high homogeneity with magnetic flux lines in the region being generally parallel to the magnet central axis. A high vacuum is established in the region and a sample cell is positioned at or within the region in which sample ions are formed, trapped, excited and detected. An ionizing device is positioned outside of the region and off the central axis while an additional ionizing device may be positioned on the central axis. In a preferred embodiment, the off axis ionizing device may be supported for movement relative to the central axis. A preferred ionizing device for the off axis device is an electron gun.

12 Claims, 4 Drawing Figures

MASS SPECTROMETER

BACKGROUND OF THE INVENTION

Field of the Invention.

Ion cyclotron resonance (ICR) is a known phenomenon and has been employed in the context of mass spectroscopy. Essentially, this mass spectrometer technique has involved the formation of ions and their confinement within a cell for excitation. Ion excitation may then be detected for spectral evaluation.

Ion formation, trapping, excitation and detection, in the environment of mass spectroscopy, are known techniques. For example, U.S. Pat. No. 3,742,212 issued June 26, 1973 to McIver discloses an Ion Cyclotron Resonance Mass Spectrometer employing these techniques. An improvement to the noted patent is disclosed in U.S. Pat. No. 3,937,955 issued Feb. 10, 1976 to Comisarow and Marshall and which is commonly designated as a Fourier Transform Mass Spectrometer. Both of the noted patents are hereby incorporated by reference. Also incorporated by reference is U.S. Pat. No. 4,581,533 issued Apr. 8, 1986 to Littlejohn and Ghaderi and which is commonly owned with the present invention.

A mass spectrometer of the type disclosed in the above incorporated patents is illustrated diagramatically in FIG. 1. In FIG. 1, a superconducting, solenoidal magnet 10 surrounds a vacuum chamber 11 while a pump 12 is connected to the vacuum chamber 11 to establish high vacuum conditions in known manner. Magnet 10 establishes a magnetic field through the vacuum chamber including a region along the geometric central axis of the magnet at which the field is high in intensity and homogeneity and wherein the magnetic flux lines are generally parallel to the central axis. A sample cell 13 is positioned at or within this region, in known manner. The arrow designated B indicates the direction of the field established by the magnet 10, at least through the region occupied by the sample cell 13.

A sample to be analyzed is introduced into the sample cell 13 via substance connections 14. An electron gun 15 is connected to a suitable power supply by electrical connections 16. Connections 14 and 16 are known in the art and are not described in detail herein. The electron beam emitted by the electron gun 15 passes through apertures in the end (trapping) plates of the sample cell 13 to impinge on a collector 17. Within the cell 13, the electron beam forms ions, in known manner.

Mass spectrometers of the prior art have been known to have problems of sensitivity, resolution and exact mass measurement. Most attempts to resolve these problems have centered around the design of the ion analyzer or sample cell—cell 13 in FIG. 1. Indeed, the disclosure of the last filed of the incorporated specifications includes an improvement in the analyzer or sample cell.

So as to take full advantage of the cell dimensions, it is important that the ions be formed in the cell at the cell center and at the center of the magnetic field. In the prior art, this has been accomplished by positioning the cell at the center of the magnetic flux lines and by positioning the electron gun 15 such that the electron beam travels along what is commonly referred to as the Z axis—the axis that is the geometrical center of the solenoidal magnet 10. It has also been the practice to position the electron gun 15 within the magnet 10 close to the cell 13. The practice has complicated the servicing of the electron gun 15 in that it is located deep inside the vacuum chamber 11 and magnet 10 and often requires the removal of the cell 13 as well. In addition, the proximity of the electron gun 15 to the cell 13 has resulted in an introduction of electrical noise into the cell 13 and interference with the detection system.

In addition to the above, the position of the electron gun on the Z axis effectively occupies the Z axis and prevents the use of an alternative ionizing device at that location. Other ionizing sources may have similar considerations to those mentioned above.

SUMMARY OF THE INVENTION

The present invention is directed to an improvment in mass spectrometers and, in particular, to mass spectrometers employing ion cyclotron resonance. Specifically, the present invention provides a positioning of an ionizing device that facilitates servicing and reduces electrical interference with the spectrometer detection system while also allowing utilization of an alternative ionizing device without removal of the first ionizing device. In a preferred embodiment, an electron gun is positioned outside of the magnet bore and off its central or Z axis with its electron beam following a magnetic flux line to, and through, a sample cell. Ions thus formed in the cell may be trapped, excited and detected in accordance with known techniques. In addition, an alternative ionizing device may be positioned on the magnet Z axis.

DETAILED DESCRIPTION OF THE PREFERRED EMBODIMENTS

Figure 1:
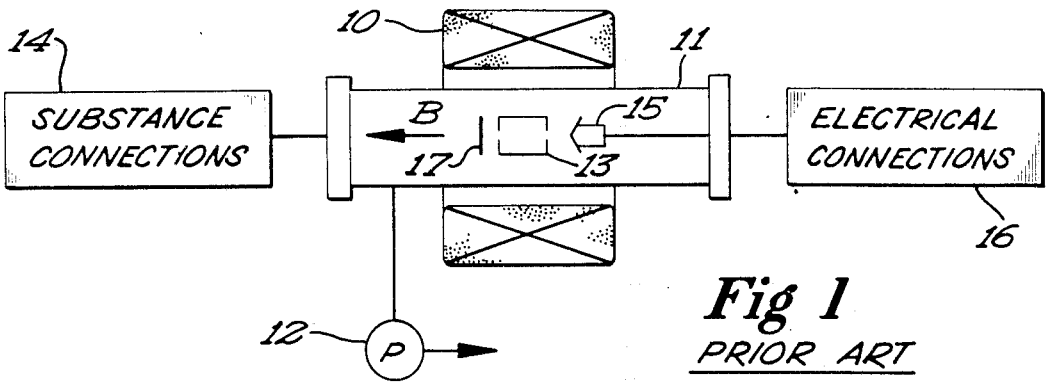
Fig 1 PRIOR ART
FIG. 1 is a diagramatic illustration of a prior art mass spectrometer.
Figure 2:
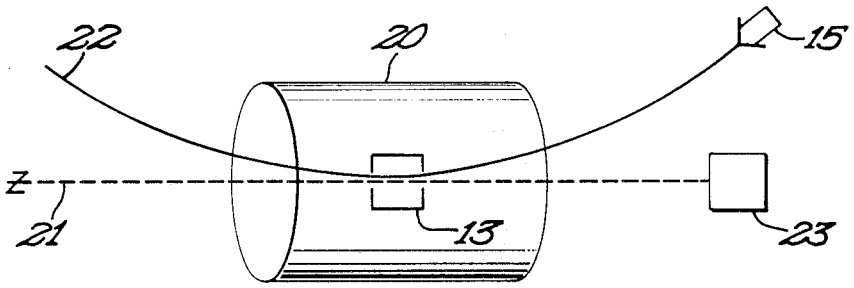
FIG. 2 is a diagramatic illustration of the concept of the present invention.

The concept of the present invention is illustrated in FIG. 2 which is a diagramatic illustration of some elements forming the mass spectrometer system of FIG. 1. Specifically, a solenoidal magnet is represented by the cylinder 20 while its central or Z axis is represented by the dashed line 21 which is also labeled with a Z. A sample cell 13, which may be identical to the sample cell 13 of FIG. 1, is positioned relative to the magnetic field of the magnet 20 as described above. Of course, a complete spectrometer system will include vacuum chamber, pump, etc.

A magnetic flux line, other than the Z axis flux line, is represented by line 22. As is known to those familiar with solenoidal magnets, several such lines of flux exist which curve around the solenoid magnet to form a closed loop. Any charged particles, such as electrons or ions, that are formed along any of the magnetic flux lines, have their movement restricted in the directions perpendicular to the particular flux line. These directions are often referred to as the X axis and Y axis directions. Movement of the charged particle along the flux line is not restricted and is related to the thermal energy of the particle and any applied accelerating fields.

It should be noted that any charged particle experiences an orbital motion within the plane defined by the X axis and Y axis (perpendicular to the flux line) when exposed to a magnetic field. This orbital motion (cyclotron motion) is known and the radius of the orbital motion is directly proportional to the mass and component of energy of the particle in the X,Y plane perpendicular to the flux line and inversely proportional to the strength of the magnetic field. For electrons, it is very small. Thus, an electron approaching the sample cell 13 along the flux line 22 of FIG. 2 would approach the cell along a helical path centered about the flux line 22 and having a decreasing diameter as the electron moves into the higher strength portions of the field. In spite of this orbital motion of the electron traveling along the flux line 22, only a small aperture is necessary in the end (trapping) plates of the sample cell 13 to allow that electron to enter the cell 13 for ionizing a sample contained therein. Thus, an electron gun, such as that designated at 15 in FIG. 1, may be positioned along the flux line 22, as illustrated in FIG. 2, with the electron beam of the gun following the flux line 22 through the sample cell 13.

The sample cell 13 is positioned within the field at or within a region along the Z axis of the magnet 20 such that the field within the cell 13 is high in intensity and homogeneity with the flux line 22, and adjacent flux lines in that region, being generally, or at least sensibly, parallel to the Z axis. By properly positioning the electron gun 15 the particular line of flux along which the electron beam travels may be generally centered relative to the sample cell to take good advantage of the cell dimensions such that ions are formed generally at the center of the cell and at the center of the magnetic field. Also, with the electron gun 15 positioned off the Z axis, that location is available for an alternative ionizing device such as that represented by the block 23 in FIG. 2. It is within the scope of the present invention that any method of sample ionization be employed such as Cesium ion or laser desorption. Indeed, any ionizing device may be employed off the Z axis so long as its output can be accelerated along a flux line. Thus, an ionizing device other than an electron gun may be positioned off axis with yet another ionizing device being positioned on the Z axis. It should be noted that in FIG. 2 both of the illustrated ionizing devices are located outside the central bore of the magnet 20.

Figure 3:
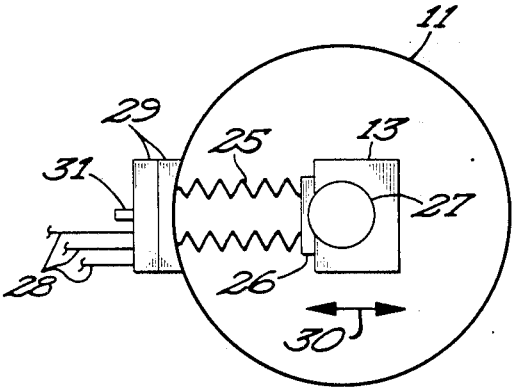
FIG. 3 illustrates a contruction that may be employed in the practice of the present invention.

FIG. 3 illustrates a system by which an ionizing device may be adjustably mounted for "off axis" movement relative to the magnet Z axis. In FIG. 3, reference numeral 13 designates the sample cell of FIGS. 1 and 2 while reference numeral 11 designates vacuum chamber of FIG. 1. A stainless steel bellows 25 extends from the inner side wall of vacuum chamber 11 and carries a mounting plate 26 on which an ionizing device 27 may be supported. Feedthroughs through the mounting plate 26 allow electrical communication between the ionizing device 27 and the exterior of vacuum chamber 11 as represented by the wires 28. The wires 28 extend through flanges 29 which serve to maintain the internal integrity of the vacuum chamber 11, in known manner.

Adjustment of the position of the ionizing device 27 is in either direction indicated by the double headed arrow 30. This adjustment may be accomplished in any desired manner as by a rod 31 extending through the flanges 29 and into engagement with the mounting plate 26 with adjustment being made by pushing or pulling on the rod 31. Alternatively, the rod 31 may be journaled to the mounting bracket and be threadedly engaged by the flanges 29, or a threaded member carried by the flanges 29, to cause the mounting plate 26 to move in one of the directions indicated by the arrow 30, on rotation of the rod 31.

Figure 4:
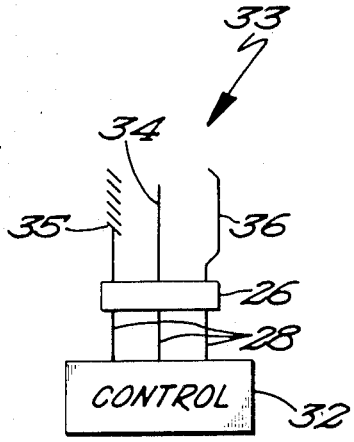
FIG. 4 illustrates a preferred electron gun that may be employed in the practice of the present invention.

FIG. 4 illustrates a preferred electron gun embodiment that may be advantageously employed within the present invention. As shown in FIG. 4, connecting lines 28 extend between a control 32 and the mounting plate 26 (see FIG. 3). The electron gun of the embodiment of FIG. 4 is formed of an electrode generally designated at 33, electrode 33 being of the type having an electron emitting filament 34. A grid 35 and a plate 36 also extend from the mounting plate 26. Operation and control of the electrode 33 and grid 35 is known to the prior art. Plate 36 may be alternatively connected, via the control 32 to the same potential as the electrode filament 34 to serve as a repeller or to ground or a positive potential for use in monitoring the electron beam. Control 32 will selectively connect the filament 34 to a negative potential and the grid 35 to ground potential for operation, in known manner.

Obviously, many modifications and variations of the present invention are possible in light of the above teachings. For example, it is presently anticipated that the "off axis" ionizing device would advantageously be an electron gun while the "on axis" ionizing device is another type of ionizing device. Of course, the selection of a particular ionizing device or devices is dependent on the particular application. Additionally, multiple "off axis" ionizing devices may be employed within the scope of the present invention. While a particular adjustable support has been illustrated, the "off axis" ionizing device may be stationary or may be supported for movement by an alternative supporting system. It is therefore to be understood that, within the scope of the appended claims, the invention may be practiced otherwise than as specifically described.

What is claimed is:

1. In a mass spectrometer of the type wherein solenoidal magnet means produce a magnetic field including a region along the geometric central axis of the magnet means of high field intensity and high homogeneity with the magnetic flux lines within said region being generally parallel to said central axis and having vacuum chamber means including said region, having sample cell means at or within said region in which sample ions are formed, trapped, excited and detected and having means for ionizing a sample within said sample cell means, the improvement wherein said ionizing means comprises means positioned outside said region and off said central axis for directing an electron beam along a magnetic flux line that passes through said region.

2. The mass spectrometer of claim 1 further comprising additional ionizing means positioned on said central axis.

3. The mass spectrometer of claim 2 wherein said additional ionizing means comprises laser means.

4. The mass spectrometer of claim 1 further comprising means adjustably supporting said ionizing means for movement relative to said central axis.

5. The mass spectrometer of claim 4 wherein said ionizing means comprises electron gun means.

6. The mass spectrometer of claim 4 wherein said adjustably supporting means comprises stainless steel bellows means.

7. The mass spectrometer of claim 6 wherein said ionizing means comprises electron gun means.

8. The mass spectrometer of claim 1 wherein said ionizing means comprises electron gun means.

9. The mass spectrometer of claim 8 wherein said electron gun means comprises electrode means, grid means and plate means, said plate means being selectively connectable to act as an electron reflector or as an electron beam monitor.

10. The mass spectrometer of claim 1 wherein said solenoidal magnet means has a central bore, said ionizing means being positioned outside said central bore.

11. The mass spectrometer of claim 10 further comprising additional ionizing means positioned on said central axis.

12. The mass spectrometer of claim 10 wherein the magnetic flux line along which said ionizing means is positioned passes through said magnet means central bore.

* * * * *